US010047934B2

(12) United States Patent
Nevitt

(10) Patent No.: US 10,047,934 B2
(45) **Date of Patent: *Aug. 14, 2018**

(54) LIGHT BULB REPLACEMENT APPARATUS AND SYSTEM

(71) Applicant: Thomas Anthony Nevitt, Dallas, TX (US)

(72) Inventor: Thomas Anthony Nevitt, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/642,870

(22) Filed: Jul. 6, 2017

(65) Prior Publication Data

US 2017/0299158 A1 Oct. 19, 2017

Related U.S. Application Data

(63) Continuation of application No. 14/693,240, filed on Apr. 22, 2015, now Pat. No. 9,726,353.

(51) Int. Cl.

| | |
|---|---|
| ***F21V 21/00*** | (2006.01) |
| ***F21V 19/04*** | (2006.01) |
| ***F21S 8/00*** | (2006.01) |
| ***F21V 15/01*** | (2006.01) |
| *F21V 23/00* | (2015.01) |
| *F21V 23/06* | (2006.01) |

(52) U.S. Cl.

CPC ..... *F21V 21/00* (2013.01); *F21S 8/036* (2013.01); *F21V 15/01* (2013.01); *F21V 19/04* (2013.01); *F21V 23/002* (2013.01); *F21V 23/06* (2013.01)

(58) Field of Classification Search

CPC ..... F21V 21/04; F21V 21/047; F21V 21/00; F21V 23/002

USPC ..... 362/364, 368, 285, 146–148, 152

See application file for complete search history.

(56) References Cited

U.S. PATENT DOCUMENTS

| | | | |
|---|---|---|---|
| 4,242,726 | A | 12/1980 | Steadman |
| 4,272,802 | A | 6/1981 | Steadman |
| 4,392,192 | A | 7/1983 | Steadman |
| 5,003,441 | A | 3/1991 | Crowe |
| 5,683,176 | A | 11/1997 | Clendenin |
| 7,540,637 | B1 | 6/2009 | Williams |
| 7,645,047 | B2 | 1/2010 | Martinez |
| 2001/0033487 | A1 | 10/2001 | Crelin |
| 2011/0075423 | A1 | 3/2011 | Van De Ven |
| 2015/0098232 | A1 | 4/2015 | Nevitt |

*Primary Examiner* — Sean Gramling

*Assistant Examiner* — Gerald J Sufleta, II

(74) *Attorney, Agent, or Firm* — Fish & Richardson P.C.

(57) ABSTRACT

A lighting apparatus includes an elongated housing defining an elongated chamber. The housing is mountable at first end to a structure. A fixture includes a receptacle that receives a light bulb. The fixture is configured to be slidably inserted into the housing from inside the structure and positioned within the elongated chamber of the elongated housing outside the structure. An alternate lighting apparatus includes a mounting apparatus having a housing including a receptacle for receiving a light bulb and a body portion connected to the housing. The mounting apparatus is positionable in a first position inside the structure and configured for receiving a light bulb inside the structure, and the mounting apparatus is postionable in a second position wherein the mounting apparatus with the housing and the received light bulb is slidably inserted through a bore in a wall of the structure and the housing is positioned outside the structure.

20 Claims, 2 Drawing Sheets

LIGHT BULB REPLACEMENT APPARATUS AND SYSTEM

CROSS-REFERENCE TO RELATED APPLICATIONS

This application is a continuation application of and claims the benefit of priority to U.S. application Ser. No. 14/693,240, filed on Apr. 22, 2015, the contents of which are hereby incorporated by reference.

TECHNICAL FIELD

This specification relates to light bulb apparatuses and systems with improved features for replacing light bulbs in the light bulb apparatuses.

BACKGROUND

Adjusting lights, including changing light bulbs that are positioned in elevated or other hard to access locations can be time consuming, dangerous, and costly. In order to adjust a light bulb in elevated locations, a lift (i.e. a cherry picker) is required. If multiple lighting apparatuses and light bulbs are provided in an area and only a single bulb goes out, it is not cost-efficient to obtain a lift to change the light bulbs or otherwise adjust the lighting apparatuses and/or light bulbs until additional light bulbs and/or lighting apparatuses need adjustment.

SUMMARY

This specification describes technologies relating to light bulb replacement apparatuses and systems.

In general, a first implementation of the subject matter described in this specification can be embodied in a lighting apparatus, comprising: an elongated housing defining an elongated chamber, the housing configured to allow mounting a first end of the housing to a structure. The lighting apparatus includes a fixture having a receptacle configured for receiving a light bulb. The fixture is positionable in a first position inside the structure and outside the elongated housing and said fixture is configured to receive a light bulb. The fixture is positionable in a second position wherein the fixture with the received light bulb is slidably inserted and positioned within the elongated chamber of the elongated housing.

In general, a second implementation illustrates a lighting apparatus, comprising: a mounting apparatus including: a positionable housing including a receptacle configured for receiving a light bulb; and a body portion connected to the positionable housing. The body portion includes an end configured to allow mounting of the body portion to a structure. The mounting apparatus is positionable in a first position inside the structure for receiving a light bulb and positionable in a second position wherein the mounting apparatus with the housing and the received light bulb is slidably inserted through a bore in a wall of the structure and the mounting apparatus including said housing positioned outside the structure.

A method for replacing a light bulb, includes the steps of: mounting a first end of an elongated housing defining an elongated chamber to an exterior wall of a structure; removably positioning a fixture including a receptacle containing a light bulb, from inside the structure through a bore in an exterior wall of the structure by sliding the fixture through the bore into the elongated chamber of the elongated housing positioning the light bulb near a midsection or proximal to a second end of the housing and above an opening in a lower portion of the housing. Then removing the fixture and the light bulb from the elongated housing by sliding the second end of the fixture and the light bulb in a direction of the structure and positioning the light bulb inside the structure; removing the light bulb when the fixture is inside the structure and replacing the light bulb while the fixture is inside of the structure; and positioning the fixture in the elongated housing outside the structure by sliding the fixture through the bore until the light bulb is positioned above an opening in a lower portion of the housing. The method further includes securing a cap of the fixture to an interior wall of the structure.

A method for replacing a light bulb, includes providing a bore from inside a structure through an exterior wall of the a structure and terminating outside the structure; removably positioning a mounting apparatus including a housing having a receptacle containing a light bulb, from inside the structure through the bore in the exterior wall of the structure by sliding the mounting apparatus through the bore; contacting at least a portion of the exterior wall surrounding an exterior end of the bore with an end of body portion of the mounting apparatus. Then withdrawing the mounting apparatus and the light bulb from the exterior of the structure by sliding the end of the body portion and the light bulb in a direction of the structure and positioning the light bulb inside the structure; removing the light bulb when the mounting apparatus is in the interior of the structure and replacing the light bulb while the mounting apparatus is in the interior of the structure; and positioning the mounting apparatus outside the structure by sliding the mounting apparatus through the bore until the end of the body portion is contacting the portion of the exterior wall surrounding the exterior end of the bore.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Like reference numbers indicate similar or like parts in the description of the figures.

Figure 1B:
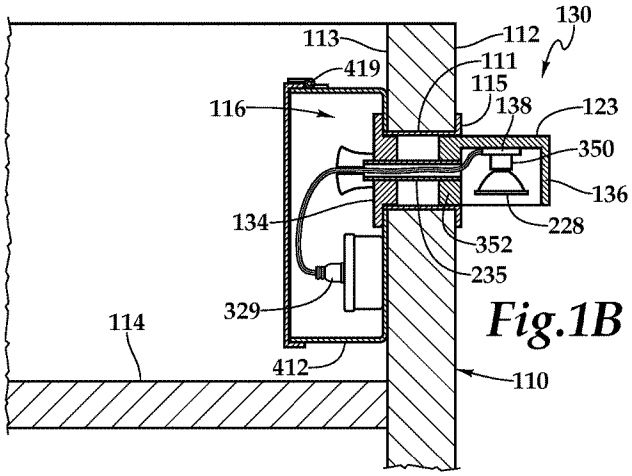
FIG. 1B is a side view of a second exemplary embodiment of a lighting apparatus extending through an interior and exterior wall of a structure with the lighting apparatus assembled in an operational mode.
Figure 1A:
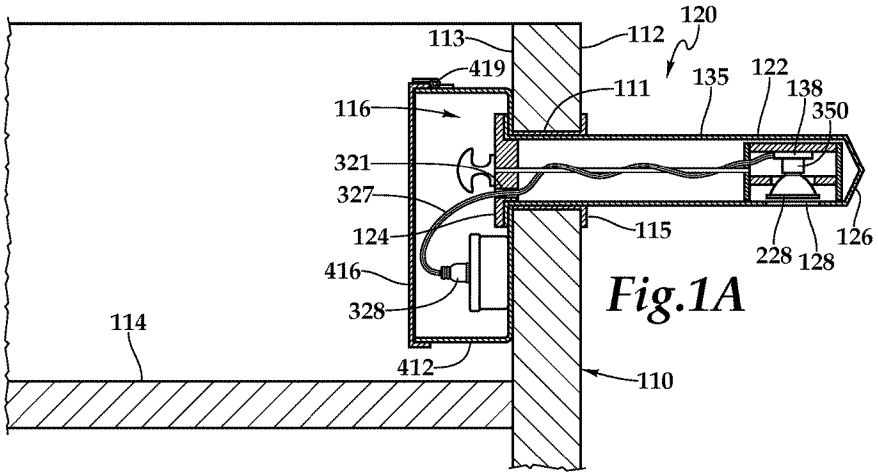
FIG. 1A is a side view of a first exemplary embodiment of a lighting apparatus extending through an interior and exterior wall of a structure with the lighting apparatus assembled in an operational mode.

FIG. 1A shows a side view of a first exemplary lighting apparatus 120 extending through an interior wall and an exterior wall of a structure 110. Structure 110 is a building, edifice, warehouse, garage, parking structure, etc., Structure 110 includes bore 111, extending from exterior wall 112 to interior wall 113, and opening facing 115 from which an external housing 122 of a lighting apparatuses 120 protrudes. Also the structure 110 includes a floor 114 from which internal portal 116 and lighting apparatus 120 is able to be accessed.

Figure 2B:
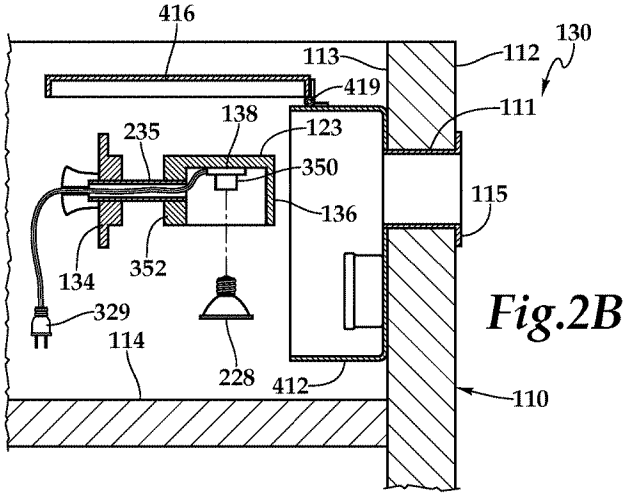
FIG. 2B is a side view of the lighting apparatus of FIG. 1B with a housing and internal elements positioned inside the structure for replacement of a light bulb in the lighting apparatus of FIG. 1B.
Figure 2A:
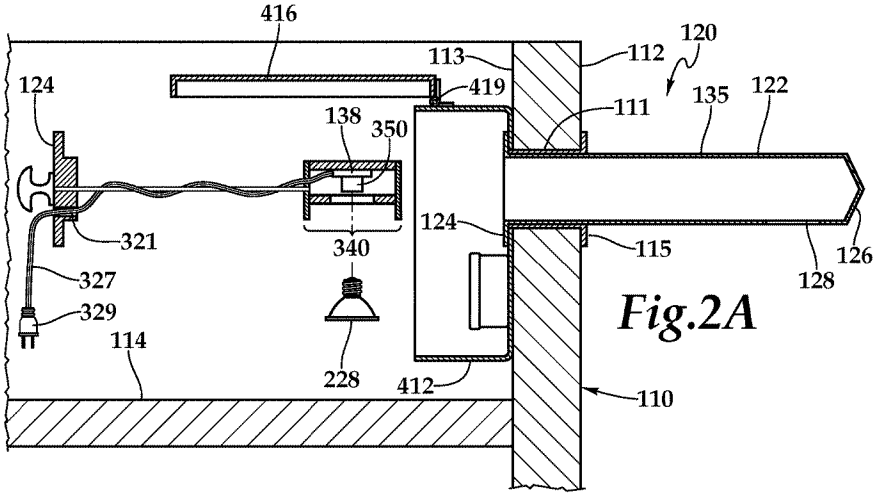
FIG. 2A is a side view of the lighting apparatus of FIG. 1A with internal elements withdrawn from an external housing and the internal elements positioned inside the structure for replacement of a light bulb in the lighting apparatus of FIG. 1A.

FIG. 2A is a side view of the lighting apparatus of FIG. 1A with some internal elements withdrawn from an external housing 122 and some internal elements positioned inside the structure 110 for replacement of the light bulb 228.

FIG. 1B shows a side view of a second exemplary lighting apparatus 130 extending through an interior wall and an exterior wall of a structure 110. Structure 110 is a building, edifice, warehouse, garage, parking structure, etc., Structure 110 includes bore 111, extending from exterior wall 112 to interior wall 113, and opening facing 115 from which the housing 123 of a lighting apparatuses 130 protrudes. Also the structure 110 includes floor 114 from which portal 116 and lighting apparatus 130 is able to be accessed. In the exemplary embodiment, shown in FIG. 1B, bore 111 extends from the exterior wall 112 to the interior wall 113.

FIG. 2B is a side view of the lighting apparatus 130 of FIG. 2A with the housing 123 and internal elements positioned inside the structure 110 for replacement of the light bulb 228.

In some embodiments one or a plurality of lighting apparatuses 120 and/or 130 are provided to extend from a structure 110 at similar or different locations (e.g., around the exterior wall 112), heights, and angles relative to the structure 110 to provide illumination to the structure 110 and/or provide illumination to objects away from structure (e.g., a sidewalk at the base of structure 110).

FIGS. 1A and 2A illustrate the lighting apparatus 120 that includes the housing 122 with a first end 124 and a second end 126, and in the current embodiment, one or more openings 128. FIGS. 1B and 2B illustrate lighting apparatus 130 including first end 134 and a second end 136, body portion 235 and mounting base 138. Lighting apparatuses 120 and 130 will be described in further detail below.

FIG. 1A illustrates lighting apparatus 120 extending through bore 111, exterior wall 112, and facing 115. In the illustrated embodiment, lighting apparatuses 120 extends approximately perpendicularly relative to exterior wall 112; however, such a configuration is not required, and in some embodiments, one or more lighting apparatuses 120 and/or 130 may extend from exterior wall 112 at any angle relative to exterior wall 112 (e.g. 0, 45, or 90 degrees, among others). Lighting apparatus 120, in the implementation shown in FIG. 2A, includes housing 122, first end 124 and a second end 126, opening 128, and light bulb 228.

The interior of housing 122 defines a chamber within housing 122. The cross-sectional area of housing 122 may be of any shape including square, rectangle, or circular, among others. The first end 124 is the end of lighting apparatus 120 positioned nearest to exterior wall 112 and interior wall 113 and is configured to be fastened to exterior wall 112, interior wall 113, or the facing 115. However, the first end 124 may be spaced apart from exterior wall 112, interior wall 113, and/or facing 115, and a fastener may extend from exterior wall 112, interior wall 113, and/or facing 115, first end 124 or another portion of lighting apparatus 120. Fasteners may include nails, adhesives, screws, nuts & bolts, among others. In the implementation, shown first end 124 extends through facing 115 and exterior wall 112, and first end 124 contacts a portal 116. However, such a configuration is not required.

Light bulb 228 may be any type of light bulb, including incandescent, halogen, fluorescent, compact fluorescent lamps, high-intensity discharge lamps, low-pressure sodium lamps, LED, among others. Further, in some implementations, more than one light bulb 228 may be included within to housing 122, and each light bulb 228 may be directed in one of a multitude of directions, or may adjustably point in different directions. In some embodiments, a single opening 128 is provided for each light bulb 228; however, such a configuration is not required, and two or more light bulbs 228 may be configured to emit light through an opening 128. Additionally, one light bulb 228 may be configured to emit light through two or more opening 128.

Figure 3A:
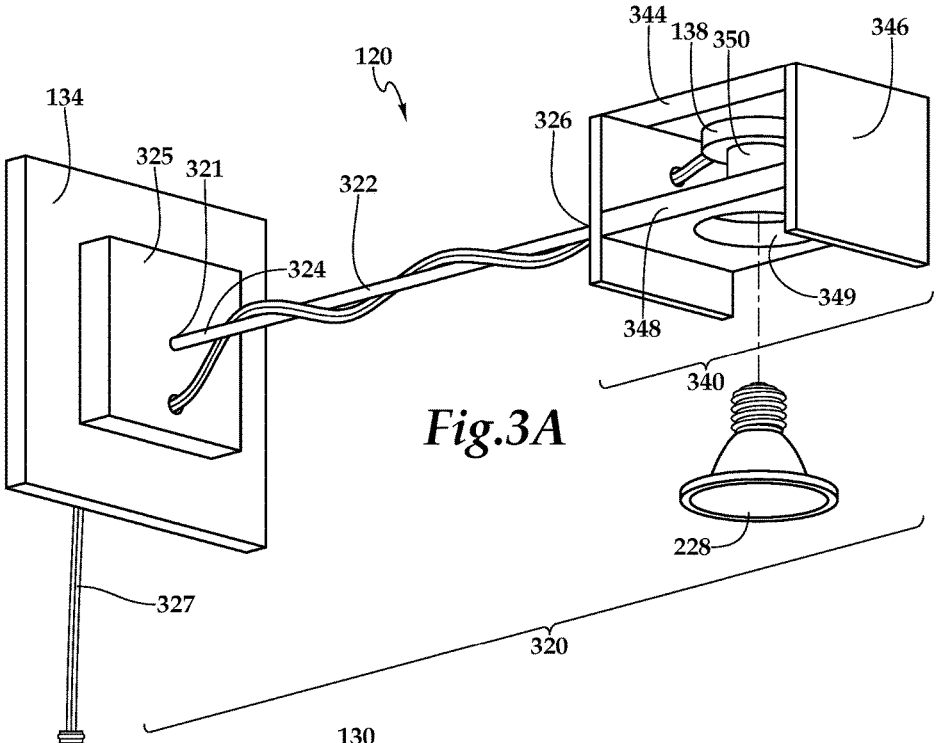
FIG. 3A is a partial perspective view of some elements of the exemplary embodiment of FIG. 1A.

FIG. 1B shows exemplary lighting apparatus 130 extending from interior wall 113 through bore 111, exterior wall 112, and facing 115. In the embodiment shown in FIG. 2B, lighting apparatus 130 extends approximately perpendicularly relative to exterior wall 112; however, such a configuration is not required, and as stated above, lighting apparatus 130 may extend from exterior wall 112 at any angle relative to exterior wall 112. Lighting apparatus 130, in the exemplary implementation shown, includes first end 134 and second end 136, body portion 235, housing 123, and light bulb 228. In the current implementation, second end 136, body portion 235, and mounting base 138 and housing 123 extend through bore 111 and facing 115. First end 134 is configured to contact interior wall 113. Light bulb 228 may be any type of light bulb, including any type described above with respect to light bulb 228. Further, in some implementations, more than one light bulb 228 may be included, and each light bulb 228 may be directed in one of a multitude of directions or may adjustably point in different directions. In some embodiments, a single fixture is provided for each light bulb 228; however, in other implementations more than the light bulb 228 may be received by fixture FIG. 3A is a partial perspective view of some elements of the exemplary embodiment of FIG. 1A that are included in lighting apparatus 120 and configured to slide into housing 122. Fixture 320 includes a body 322 with first end 324 and second end 326, end cap 325, and light bulb 228. As shown, fixture 320 includes end cap 325, which is fastened to or a component of first end 324 of body 322. End cap 325 may be fastened to first end 324 by adhesive, staples, nails, and/or bolts, among others. End cap 325 is configured to secure the fixture 320 to portal 116 or a component of interior wall 113 (seen in FIG. 1A). An electrical cord 327 extends through a bore 321 in end cap 325. In some embodiments, electrical cord 327 may not be included (if such a cord is not required) or electrical cord 327 may extend to an electrical outlet in a manner not requiring it to extend through bore 321.

Exemplary fixture 320 has second end 326 connected to light bulb mounting component 340. As shown, light bulb mounting component 340 is configured to secure the light bulb 228 in fixture 320. Light bulb mounting component 340, in the implementation shown in FIG. 3A, includes structural support members 344 and 348 and end plate 346. Light bulb support member 348 may include a bore 349, which may be the same shape or a different shape than light bulb receptacle 350 (e.g. socket). The bore 349, in some implementations, is configured receive the mounting base 138 and receptacle 350 for bulb 228. For example, light bulb 228 may be secured to receptacle 350 via threads on the exterior of at least a portion of light bulb 228 and mating threads in receptacle 350.

Figure 3B:
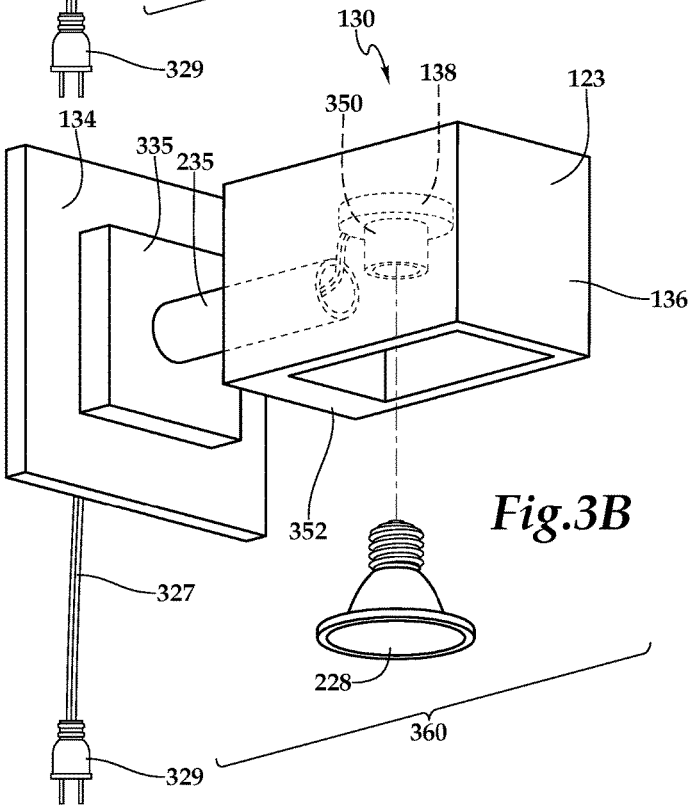
FIG. 3B is a partial perspective view of some elements of the exemplary embodiment of FIG. 1B.

FIG. 3B is a partial perspective view of some elements of the exemplary embodiment of FIG. 1B. Lighting apparatus 130 includes a mounting apparatus 360, a first end 134 and a second end 136, body portion 235, mounting base 138, receptacle 350, housing 123, and light bulb 228. Lighting apparatus 130 includes inside end cap 335 configured to secure lighting apparatus 130 to structure 110. Also, in some implementations, lighting apparatus 130 is configured to include an electrical cord 327. The electrical cord 327 may include a plug 329 for connection to a standard electrical outlet for providing power to the lighting apparatus 130 or may be hard wired into an electrical circuit without a plug 329. The electrical cord may pass through an opening 328 in the end cap and pass through the body portion of 235 and connect to the mounting base 138 with the light bulb receptacle 350 for receiving bulb 228.

The second implementation lighting apparatus 130 of FIGS. 1B, 2B and 3B, differs from the first implementation of FIGS. 1A, 2A and 3A, primarily in that the mounting apparatus 360 includes housing 123, where the entire mounting apparatus 360 and the housing 123 is able to be withdrawn through bore 111 into the interior of structure 110 to change bulb 228 as distinguishable from the first embodiment wherein the housing 122 is external and is not withdrawn into the structure 110 when bulb 228 is changed. The housing 123, in the second exemplary implementation shown in FIG. 3B, includes support sealing panel 352 that seals in the facing 115 of exterior wall 112. The light bulb 228 may be secured to receptacle 350 via threads on the exterior of at least a portion of light bulb 228 that mate threads in receptacle 350. Alternatively, or additionally, pin and socket connectors may be used.

FIGS. 1A and 1B are side views of exemplary lighting apparatus 120 and 130 in an operational position with the lighting apparatus disposed outside of structure 110. FIGS. 2A and 2B illustrate certain features of the lighting apparatus 120 and 130 withdrawn inside the structure for changing their respective light bulbs 228. The interior wall 113 also shows portal 116, which may be configured as a junction box 412 with a cover 416. The junction box 412 and/or cover 416 may include an opening (not shown) for electrical cord 327 (with or without a plug 329) to pass through the portal 116. Electrical cord 327 may be configured with plug 329 received in an electrical receptacle or electrical circuit positioned outside the junction box.

The configuration of portal 116 and junction box 412 in the current implementation is not required, and other configurations may be used. For example, portal 116 may be configured for the cover 416 to be removed from body portion 412, cover 416 may not be included, hinge 419 may be in a different location of body portion 412, or hinge 419 may not be included.

In operation as illustrated in FIG. 1A, with regard to the exemplary lighting apparatus 120, first end 124 of the housing 122 is to be fastened, or otherwise secured, to the structure 110 at a desired angle relative to the structure 110 and positioned in line with bore 111 (extending from interior wall 113 to exterior wall 112. Fixture 320, with light bulb 228 secured to the fixture 320, is configured to be extended into housing 122 toward distal end 126. Fixture 320 is then configured to be secured to the structure 110. In some embodiments, end cap 325 is configured to contact the bore 111, interior wall 113, and/or the body portion 412 of portal 116.

As illustrated in FIG. 2A, in order to adjust or replace the one or more light bulbs 228, in the first implementation, the fixture 320 is pulled toward the interior wall 113 of the structure 110, which is enabled to be performed by pulling end cap 325. When a user can reach the light bulb 228, the user is then enabled to adjust the light bulb 228, which includes, for example, replacing light bulb 228. In the first implementation, fixture 320 can be pulled completely through housing 122 and to or past interior wall 113. After one or more adjustments are made to the light bulb 228, lighting apparatus 120 can be reconfigured to the lighting position by extending the fixture 320, with light bulb 228, into the housing 122 toward the distal end 126. Second end 126, in some implementations may be positioned approximately two feet from the exterior wall 112 of the structure 110 when housing 122 is secured to the structure 110.

Referring to FIG. 1B, in operation, with regard to second exemplary lighting apparatus 130, light bulb 228 is secured in the receptacle 350 of mounting apparatus 360 which includes housing 123. The housing 123 is configured to extend from the exterior wall 113 and to a distance away from the exterior wall 112 (for example, seen in FIG. 1B). Lighting apparatus 130 is then configured to be secured to the structure 110. In some embodiments, end cap 335 is configured to contact the bore 111 and/or the interior wall 113.

Referring to FIGS. 2B and 3B, in order to adjust or replace the one or more light bulbs 228, in the second implementation, the second end 136 is pulled toward the interior wall 113 of the structure 110, which is enabled to be performed by pulling end cap 335 positioned on end 134. When a user can reach the light bulb 228, the user is then enabled to adjust the light bulb 228, which includes, for example, replacing light bulb 228. In some implementations, lighting apparatus 130 can be pulled completely to or past interior wall 113 (e.g., where the second end 136 is pulled within structure past interior wall 113). After one or more adjustments are performed to the light bulb 228, lighting apparatus 130 can be reconfigured to the lighting position by extending the mounting apparatus 360 through the bore 111 and housing 123 from the exterior wall 113 and to a distance away from the exterior wall 112 (for example, seen in FIG. 1B). Exemplary lighting apparatus 130 is then configured to be secured to the structure 110, as described above.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A lighting apparatus, comprising:

an elongated housing defining an elongated chamber including a first end and a second end, the elongated housing configured to allow mounting the first end of the elongated housing to a building and the second end away from the building; and a fixture removably positionable in the elongated chamber, said fixture including a receptacle configured for receiving a received light bulb; and wherein, said fixture being slidable inside the elongated chamber in a first direction toward the first end of the housing and said fixture being positionable in a first position the building and outside of the elongated housing, and said fixture being slidable inside the elongated chamber in a second direction toward the second end of the housing and said fixture with the received light bulb being further positionable in a second position wherein the fixture with the received light bulb is positioned within the elongated chamber of the elongated housing away from the building.

2. The lighting apparatus of claim 1, wherein the first end of the housing is adapted to be removably mounted to the building at a first side of a wall of the building and extendible through a bore from the first side of the wall through the wall of the building.

3. The lighting apparatus of claim 2, wherein a portal is adapted to be positioned on an inside surface of the first side of the wall of the building-and the portal at least partially surrounds the bore, and at least a portion of the elongated housing contacts the portal.

4. The lighting apparatus of claim 1 wherein the elongated housing includes an opening adapted to position the received light bulb at least partially over the opening when the fixture and the received light bulb are positioned at the second position inside the elongated housing.

5. The lighting apparatus of claim 2, wherein the first end of the housing includes a cap configured to seal in the bore through the wall of the building.

6. The lighting apparatus of claim 2, wherein the fixture includes a light bulb mounting component secured to the fixture, the light bulb mounting component adapted to receive and hold the light bulb.

7. The lighting apparatus of claim 6, wherein the light bulb includes threads and the light bulb mounting component includes a receptacle with mating threads for receiving the threads of the light bulb.

8. The lighting apparatus of claim 1, wherein the elongated housing includes a plurality of openings, each opening adapted to receive the received light bulb positioned at least partially over at least one of the openings when the fixture and the received light bulb(s) is positioned in the elongated chamber of the elongated housing.

9. The lighting apparatus of claim 7 wherein the portal comprises an electrical junction box positioned on the first side of the wall of the building with an operable cover, said electrical junction box being configured to allow the fixture to be slidably removed from the housing.

10. The lighting apparatus of claim 9 wherein the electrical junction box includes an electrical outlet configured for receiving an electrical plug connected to an electrical cord connected to the receptacle.

11. A lighting apparatus, comprising:

a mounting component including:

a housing including a receptacle configured for receiving a light bulb; and a body portion connected to the housing said body portion including a first end configured to allow mounting of the body portion to a first side of a wall of a building; and wherein, said mounting component being slidable through a bore extending from the first side of the wall to a second side of the in a first direction toward the first side of the wall of the building and said mounting component being positionable in a first position proximal to the first side of the wall of the building and spaced apart from the first side of the wall and said mounting component being configured for receiving a received light bulb when the mounting component is proximal to the first side of the wall of the building and spaced apart from the first side of the wall, and said mounting component slidable through the bore in a second direction toward the second side of the wall and positionable in a second position wherein the housing and the received light bulb is positioned away from the building.

12. The lighting apparatus of claim 11, wherein a portal is adapted to be positioned at the first side of the wall of the building and the portal at least partially surrounds the bore, and at least a portion of the mounting component contacts the portal.

13. The lighting apparatus of claim 11 wherein the first end of the mounting component includes an end cap configured to secure the lighting apparatus to the building.

14. The lighting apparatus of claim 11, wherein the light bulb includes threads and the receptacle of the mounting component includes mating threads for receiving the threads of the light bulb.

15. The lighting apparatus of claim 12 wherein the portal comprises an electrical junction box with an operable cover, said electrical junction box being configured to allow the mounting component and housing to be slid through the bore.

16. The lighting apparatus of claim 15 wherein the electrical junction box includes an electrical outlet configured for receiving an electrical plug connected to an electrical cord connected to the receptacle for the light bulb.

17. A method for replacing a light bulb, comprising the steps of:

mounting a first end of an elongated housing defining an elongated chamber to an exterior side of a wall of a building;

removably positioning a fixture including a receptacle containing a light bulb by sliding through a bore from a second side of the wall to the exterior side of the wall of the building the fixture into the elongated chamber of the elongated housing and positioning the fixture away from the building with the light bulb near a midsection or proximal to a second end of the elongated housing and above an opening in a lower portion of the housing; and removing the fixture and the light bulb from the elongated housing by sliding the fixture and the light bulb in a direction toward the building and positioning the fixture and the light bulb spaced apart from the second side of the wall of the building;

removing the light bulb when the fixture is spaced apart from the second side of the wall of the building and replacing the light bulb while the fixture is spaced apart from the second side of the wall of the building; and re-positioning the fixture in the elongated housing spaced apart from the exterior side of the wall of the building by sliding the fixture through the bore until the light bulb is positioned above the opening in a lower portion of the housing.

18. The method of claim 17, wherein the step of re-positioning the fixture in the elongated housing further includes securing a cap of the fixture to a second side of the wall of the building.

19. A method for replacing a light bulb, providing a bore through a wall of a building;

removably positioning a mounting apparatus including a body portion and a housing having a receptacle containing a first light bulb by sliding the housing through the bore in the wall and positioning the housing spaced apart from an exterior side of the building;

withdrawing the housing and the first light bulb by sliding the body portion and the first light bulb in a direction toward the building and positioning the first light bulb spaced apart from a second side of the wall of the building;

removing the first light bulb from the receptacle when the mounting apparatus is spaced apart from the second side of the wall of the building and replacing the first light bulb with a second light bulb while the mounting apparatus is spaced apart from the second side of the wall of the building; and re-positioning the housing and second lightbulb spaced apart from the second side of the wall of the building by sliding the housing and second light bulb through the bore until the housing and second light bulb is positioned spaced apart from the exterior side of the wall of the building.

20. The lighting apparatus of claim 19 wherein the housing includes a support sealing panel configured to seal in a facing of the first exterior side of the wall of the building.

* * * * *